United States Patent [19]

Smith

[11] Patent Number: 4,613,523

[45] Date of Patent: Sep. 23, 1986

[54] COAL COATING METHOD

[75] Inventor: Charles E. Smith, Louisville, Ky.

[73] Assignee: Koal-Kote, Inc., Louisville, Ky.

[21] Appl. No.: 458,830

[22] Filed: Jan. 18, 1983

[51] Int. Cl.[4] ..... B05D 7/00

[52] U.S. Cl. ..... 427/220

[58] Field of Search ..... 427/212–213, 427/214, 220

[56] References Cited

U.S. PATENT DOCUMENTS 3,908,045 9/1975 Alterman et al. ..... 427/213

3,982,052 9/1976 Bearce ..... 427/212

4,092,187 5/1978 Hildebrant et al. ..... 427/212 X 4,336,284 6/1982 Wallace ..... 427/213

*Primary Examiner*—Bernard D. Pianalto

*Attorney, Agent, or Firm*—Jon C. Winger

[57] ABSTRACT

A process and method and composition for coating coal particles including mixing at least two molar equivalents of a fatty acid or fatty ester and at least one molar equivalent of alkali reactive with the fatty acid allowing the alkali to saponify a portion of the fatty material to form a soap mixture diluting the soap mixture to a selected viscosity, applying the resulting solution to the coal particles, and allowing the solution to dry on the coal to form a coating on the coal particles.

12 Claims, No Drawings

COAL COATING METHOD

BACKGROUND OF THE INVENTION

The present invention relates to methods for protective treatment of coal to maintain quality of the coal during shipment by, inter alia, reducing increase in moisture and volatility of the coal during shipment or storage.

After coal is mined or otherwise recovered, it is generally stored and commences to deteriorate generally by loss of heat value and increase in moisture and volatility. The international market for coal has grown rapidly during recent years and, because most of the coal in the United States is mined in the interior States of the country, it is necessary to ship the coal long distances to ports for overseas transshipment. Typically, the coal is shipped in open railroad cars or barges and during such shipment the moisture content of the coal increases and the heating value, in many instances increases in volatility.

The increased volatility, increased moisture, and decreased heat value which occurs during shipment of coal generally leads to penalties assessed against seller so that upon arrival at a port or other shipping point the coal is reanalyzed and the sale price adjusted accordingly. One reason for the penalty is that in the case of increased moisture the shipper is in effect paying for the overseas shipment of water. In some cases the moisture increase may be significant for example, up to 4% to 6% of the total weight of the coal may be moisture. In such cases, the penalty which must be paid by the seller as reduced selling price may be significant.

In general, the same deterioration occurs in open air storage of coal. Further, even though the coal is generally washed prior to shipment, the shipped coal still includes significant quantities of fines or coal dust which provide a hazard due to the potential of fire since the dust is far more easily ignited than are the coal particles themselves.

No prior art procedure or composition is known for treating coal prior to overland or waterway shipment for a long distance which diminishes the likelihood of accidential ignition and associated hazards due to the burning of the coal dust associated with coal and which substantially reduces the deterioration which occurs during storage or shipment in the open.

SUMMARY OF THE INVENTION

The present invention provides a new and useful method and composition for coating coal after removal from the mine and at, or prior to, shipment for subsequent use or transshipment. Methods, procedures and compositions within the scope of the present invention have been found to unexpectedly reduce the moisture pickup which normally occurs when coal is shipped in open containers and which further diminishes the increase in volatility which normally occurs during shipment or storage of the coal. Further, methods within the scope of the present invention include in the case of shipment of coal, the overspraying of layers of the coal with an epoxy based resin system as the coal is loaded into the shipment container.

More particularly, the present invention provides a process and method and composition for coating coal particles including mixing at least two molar equivalents of a fatty acid or fatty ester and at least one molar equivalent of alkali reactive with the fatty acid allowing the alkali to saponify a portion of the fatty material to form a soap mixture diluting the soap mixture to a selected viscosity, applying the resulting solution to the coal particles, and allowing the solution to dry on the coal to form a coating on the coal particles.

Methods within the scope of the present invention include dilution of the soap mixture with an alcohol soluble in water and the fatty acid or ester of the soap mixture to facilitate application of the material to the coal particles.

DETAILED DESCRIPTION OF THE INVENTION

Several examples in accordance with the present invention will be discussed hereinafter but it is to be understood that the examples discussed are not by way of limitation and that various other compositions and applications within the scope of the present invention will occur to those skilled in the art upon reading the disclosure set forth hereinafter.

Further, in examples within the scope of the present invention have used primarily acids of animal fat based materials for purposes of facilitating the computation of the proportions of the reactants to be used. However it is to be understood and it has been found that the esters of the fatty acids operate satisfactorily to achieve the results of the present invention. More particularly, the illustrative examples presented herein are utilized using oleic acid. However, it is to be understood, and it has been found, that other acids such as palmitic acid or esters work equally as well in practice.

In a first example 840 grams of oleic acid was mixed initially with 100 grams of sodium carbonate. The resulting mixture, was allowed to stand to accomplish at least a partial reaction of the oleic acid. It is to be noted that the molar ratio of the reactants was in the range of 3 mole of oleic acid to one mole of caustic to form a soap mixture.

It has been found that this minimum ratio will provide the desired results and that the sodium carbonate can be increased to the point where the molar ratio is generally equal to 1 to 1 of caustic material to fatty acid. Further it has been found that in addition to sodium carbonate, alkali material such as hydrox, potassium hydroxide, sodium hydroxide, other of the alkali materials recognized as saponification agents can be utilized in connection within the formation of compositions within the scope of the present invention.

The foregoing composition was then diluted with water to form a solution and to adjust viscosity. It has been found that the solution can be diluted up to 20 times with water by volume and will still provide the necessary protection to the coal particles.

It has further been found that the effectiveness of the compositions is enhanced by the addition of 1–10% by weight of alcohol to the diluted mixture. Methyl, ethyl, propyl and isopropyl alcohol have been found equally effective.

In one test the composition was then applied to coal passing through $\frac{1}{2}''$ by $\frac{1}{4}''$ screens. It was noted that the appearance of the coal which had been treated was greatly improved and that the treated particles did not readily yield dust. The particles were then exposed to an atmosphere with 100% humidity for 24 hours. It was found that the gain in moisture of treated and untreated particles was approximately the same. However, when the particles were exposed for 1 hour to water the treated particle experienced only 1.12% gain in moisture while the untreated particles experienced a 5.12% gain in moisture.

Likewise the volatility of the treated particles increased only 0.18% while the volatility of the untreated coal increased 0.42%.

The effect of the treatment with the solution of the present invention is not fully understood but it is thought to be possible that the saponification product and alcohol where used, co-reacts in some manner with the untreated fatty acid or esters to form a protected coating which may in part penetrate the coal particles to protect the particles.

It has been further found that by further diluting the soap solution with a solvent soluble in both the water and soap solution, such as methyl alcohol the ability of the solution to coat the coal particles and adhere to the coal surface is enhanced.

The present invention can be accomplished by coating the particles of coal prior to storage or shipment either by spraying the material on the coal particles or by dipping the particles into the solution.

Moreover the present invention further compliments a method of protecting otherwise untreated coal for shipment in open containers by covering the surface of the coal in the container, at several levels if desired, with the solution by spraying over the surface of the coal in the container to surface coat the shipment. Finally in some instances overcoating of an epoxy resin system, for example a system composed of Celanese Epi Rez TM 8534 and Celanese Epi Cure TM 2036 which is then sprayed over the surface of the coal to provide additional protection to the previous coating.

The invention claimed:

1. A process for coating coal particles including (a) mixing at least two molar equivalents of a fatty acid and one molar equivalent of alkali reactive with said fatty acid to saponify a portion of said fatty acid to form a first mixture;

(b) diluting said first mixture with water to form a second solution;

(c) applying said second solution to the surface of said coal particles.

2. The invention of claim 1 wherein said alkali is dissolved in water.

3. The invention of claim 1 wherein said fatty acid includes fatty esters of said fatty acid.

4. The invention of claim 1 wherein said fatty acid includes oleic acid.

5. The invention of claim 1 wherein said alkali is sodium carbonate.

6. The invention of claim 1 wherein said alkali is sodium hydroxide.

7. The invention of claim 1 wherein said alkali is potassium hydroxide.

8. The invention of claim 1 wherein the quantity of alkali added to said first mixture is less than the strochiometric amount necessary to fully react with said fatty acid.

9. The invention of claim 1 wherein said first mixture includes a water soluble alcohol.

10. The invention of claim 9 wherein said alcohol includes methyl alcohol.

11. The invention of claim 9 wherein said alcohol includes propyl alcohol.

12. The invention of claim 9 wherein said alcohol includes isopropyl alcohol.

* * * * *